US007722167B2

(12) United States Patent
Pechtl

(10) Patent No.: US 7,722,167 B2
(45) Date of Patent: May 25, 2010

(54) METHOD AND APPARATUS FOR PRODUCING AND DEFLECTING INK DROPS

(75) Inventor: Klaus Pechtl, Stadtschwarzach (DE)

(73) Assignee: KBA-Metronic AG, Veitshoechheim (DE)

( * ) Notice: Subject to any disclaimer, the term of this patent is extended or adjusted under 35 U.S.C. 154(b) by 126 days.

(21) Appl. No.: 12/166,728

(22) Filed: Jul. 2, 2008

(65) Prior Publication Data

US 2009/0009566 A1 Jan. 8, 2009

(30) Foreign Application Priority Data

Jul. 6, 2007 (DE) ..... 10 2007 031 660

(51) Int. Cl.
*B41J 2/09* (2006.01)

(52) U.S. Cl. ..... 347/77

(58) Field of Classification Search ..... 347/77, 347/78–80, 82, 73
See application file for complete search history.

(56) References Cited

U.S. PATENT DOCUMENTS

| | | | | |
|---|---|---|---|---|
| 3,595,994 | A | 7/1971 | Whitman | 178/6.6 |
| 4,190,844 | A | 2/1980 | Taylor | 346/75 |
| 4,287,522 | A | 9/1981 | Meyer | 346/75 |
| 6,364,470 | B1 | 4/2002 | Cabal | 347/82 |
| 7,273,270 | B2 * | 9/2007 | Katerberg | 347/76 |
| 2003/0156169 | A1 * | 8/2003 | Martin et al. | 347/77 |
| 2005/0248618 | A1 | 11/2005 | Pinard et al. | 347/54 |
| 2006/0180517 | A1 | 8/2006 | Frazier | 209/579 |

FOREIGN PATENT DOCUMENTS

| | | |
|---|---|---|
| DE | 103 07 055 | 9/2004 |

* cited by examiner

*Primary Examiner*—K. Feggins
(74) *Attorney, Agent, or Firm*—Andrew Wilford

(57) ABSTRACT

The invention relates to a method and an apparatus for producing and/or deflecting ink drops, in particular in a continuously operating ink-jet printer, in which a continuous, cohesive ink stream is emitted from a nozzle of a pressure chamber, with spaced sonic pulses (140, 150) acting on an ink stream (9, 11, 12) that is at least partially cohesive or in the form of drops in the dispersion direction (100, 100*a*) of the ink stream; by the effect of each of the spaced sonic pulses (140, 150) on the ink stream (9, 11, 12), an ink drop (11, 13) may be separated from the ink stream (9, 11, 12) and/or deflected, in particular by the same angle, from the original dispersion direction (100, 100*a*) of the ink stream (9, 11, 12), such that a group of ink drop streams (13), in particular parallel ink drop streams, may be/is produced.

26 Claims, 7 Drawing Sheets

METHOD AND APPARATUS FOR PRODUCING AND DEFLECTING INK DROPS

The invention relates to a method of producing and/or deflecting ink drops, in particular in a continuously operating ink-jet printer, in which a continuous, cohesive ink stream is emitted from a pressure chamber. The invention further relates to an apparatus for producing and/or deflecting ink drops from an at least partially cohesive ink stream or an ink stream in the form of drops, including a pressure chamber having a nozzle for producing a continuously emitted, cohesive ink stream.

Continuously operating ink-jet printers have been used industrially for many years for labeling a wide variety of products. The operating principle of these ink-jet printers used up to now functions in such a way that printing ink is conveyed via a pump at superatmospheric pressure from a supply into a printing cartridge located in the actual printing head, which printing cartridge has a nozzle on the side facing the goods to be printed.

Here, the nozzle has an opening diameter in the range of, for example, 30 μm to 200 μm. The ink stream is emitted from the nozzle initially as a continuous ink stream that however is not suitable for writing because the printed symbols produced in this process are composed of individual dots or individual ink drops.

In order to separate the ink stream into individual, identical ink drops, a modulator is attached to the pressure chamber that creates fluctuations in pressure in the escaping ink stream, such that, after traversing exiting the nozzle and traveling through a defined distance, the stream quickly breaks up into individual, identical ink drops. Here, the size of the ink drops depends on the modulation frequency that was applied, the diameter of the nozzle, and the pressure produced by the pump, and may be adjusted within the limits of the system as determined by the above-described parameters. In this instance, a variation of drop size of consecutive ink drops in not possible.

Shortly before separation of the ink drops from the escaping ink stream, the ink drops are each provided with an individual electrical charge, with the size of the charge being determined by the desired point of impact on the product to be labeled. In order to guarantee the electrical charge, the ink has a low degree of electrical conductivity.

During the charging process, the ink drop has not yet separated from the ink stream issuing from the nozzle, such that, due to the electrical influence, free charge carriers in the ink, depending on the polarity and strength of an exterior charging voltage, are moved toward or away from the charging electrode, with the ink chamber and thus the ink reservoir, for example, being held at a ground potential. Here, the charging electrode has no mechanical contact with the ink stream.

If the ink drop now separates from the ink stream while it is located in the field of the charging electrode, the electrical charges that have been imparted to the drop by virtue of the influence remain in the drop, and the drop is electrically charged even after its outward separation. If, for example, the charging electrode is positively charged, then the negative free charge carriers in the ink wander into the field, while the positively charged free charge carriers in the ink are pushed out of the electrical field.

In so doing, a charge separation occurs immediately before separation of the drop on the front edge of the ink stream and the imbalance in charges thus produced is maintained in the separating drop and, in this example, the drop leaves the field range of the charging electrode with a negative charge.

Since the ink drop separates during the period of influence of the charging voltage on the drop according to the construction and as a matter of principle a level of charge remains as described on the separated ink drop whose magnitude corresponds to the magnitude of charging voltage applied, if the electrical conductivity of the ink is constant, and, if the charging voltage is changed, the magnitude of the charge on each drop may be changed as well.

On their initially straight-line flight, the electrically charged ink drops arrive in the electrostatic field of a plate capacitor and, depending on their individual charge, are deflected to a greater or lesser degree from their straight flight path and, after leaving the electrostatic field, continue to fly at an angle to their initial flight path dependent upon their charge.

Using this principle, different points of impact on an object to be labeled may be selected for individual ink drops, albeit in this embodiment this occurs in only one direction of deflection. In order to mask individual drops from the printed image or when printing is not supposed to occur, the ink drops are given a certain fixed charge or remain uncharged, such that, after exiting the electrostatic field of the plate capacitor, they arrive in a collection tube from which they are pumped back into the ink tank via a pump system. Thus, the ink that has not been used for printing is recirculated, which has led to the designation of continuously operating ink-jet printers.

The disadvantage of the conventional embodiment described above is that, due to the manner in which the drops are deflected, which is inherent in the system, the ink itself must have electrical conductivity, albeit only to a low degree, such that the individual charge amount required for electrostatic deflection may be applied to each individual ink drop.

This limits the number of inks that may be used because it is not possible or practical for every desired ink composition for the ink to be made with electrically conductive, either by itself or by means of additives. One example of such a case is an ink that has magnetic properties. Such an ink could be given electrical conductivity by means of an additive, for example; however, due to the effects or induction that occur and the associated additional deflection forces, the flight paths of the individual ink drops cannot be controlled.

In contrast, DE 103 07 055, describes a method of deflecting ink drops that deflects ink drops produced in the conventional manner using pressure modulation by means of ultrasonic waves, deflecting them to different degrees depending on the sonic energy used.

The advantage of this type of deflection is that the inks to be used for printing no longer need have any electrical conductivity, which allows the use of a large number of many types of ink with a wide array of properties.

One disadvantage of the method described in DE 103 07 055 is that, on the one hand, precise synchronization must occur between drop production and drop deflection, which must also take into account the finite dispersion speed of the sonic waves at the point of deflection dependent upon the local ambient conditions in order to allow the precise deflection of an ink drop to the desired position. A further disadvantage is that, when a simple sonic-energy generator is used, due to the size of the surface producing it, the sonic energy does not act exclusively on the ink drop to be deflected; instead it also acts at least somewhat on the drops preceding and trailing the ink drop, for which reason the precise deflection of the ink drops is possible only to a limited degree.

Another disadvantage is that, due to their production, the deflected ink drops all have the same size, for which reason it is possible to produce a printed image with different line thicknesses only by overlapping multiple ink drops, which can be achieved only in stages.

Another disadvantage is that the deflected ink drops may be deflected only in a fan shape such that, depending on the distance to the material to be printed, a different type size results.

The object of the invention is therefore to create a method and an apparatus by means of which it is possible for the disadvantages mentioned above to be eliminated and to produce ink drops of a certain size using sonic energy and deflect them in a certain direction in a targeted fashion. The further object of the invention is to create a method and an apparatus by means of which it is possible to produce ink drops of different sizes within print to be applied and to deflect them in a desired direction.

This object is attained according to the invention in that, in contrast to the known techniques, the production of individual ink drops from a continuous and cohesive ink stream after leaving the nozzle of the pressure chamber occurs in that sonic pulses act at a spacing from one another transversely on an ink stream that is at least partially cohesive or composed of drops in the direction of dispersion of the ink stream; by the effect of each of the spaced sonic pulses on the ink stream, an ink drop is deflected from the original longitudinal travel direction of the ink stream, in particular by the same angle, such that a group of ink drop streams may be produced, in particular parallel to one another.

This object is further attained by an apparatus of the type mentioned at the outset in which multiple sonic-energy generators are arranged at a spacing from one another along the longitudinal travel direction next to an ink stream that is at least partially cohesive or in the form of drops, by means of which sonic pulses directed at the ink stream may be produced; by the effect of each of the spaced sonic pulses on the ink stream an ink drop is deflected from the original longitudinal travel direction of the ink stream, in particular by the same angle, such that a group of ink drop streams may be produced, in particular parallel to one another.

This solution is based on the core concept of the invention that, by means of at least one sonic pulse, preferably a bundled ultrasonic pulse or hypersonic pulse, a certain section of the at least partially cohesive ink stream or a drop of an ink stream that is already composed of drops is removed from this ink stream and is deflected into a flight path deviating from its original flight path. This may be done by providing one sonic-energy generator for each of the spaced sonic pulses or one sonic-energy generator for producing multiple spaced sonic pulses transverse to the ink stream, preferably at a 90° angle, the generators being actuated by an appropriate electrical actuation via a supervisory control unit and, in particular, are able to transmit short sonic impulses. Furthermore, provision may be made here according to the invention for the sonic pulses to be focused, for example, in that a focusing apparatus for the sonic waves is provided between a given sonic-energy generator and the ink stream, by means of which the spaced sonic pulses generated by the spaced sonic-energy generators may be focused at multiple addressable focal points along the longitudinal travel direction of the ink stream.

Here, provision may preferably be made according to the invention for the ink stream to run through the respective focal points and/or for the focal points to be able to be focused on the ink stream such that the sonic energy of the sonic pulses may act on the ink stream in the best possible fashion.

If, for example, the ink stream in this connection, which is at least partially still cohesive, is impacted in a focal point of the sonic-energy generator by at least one sonic pulse, then the energy transferred to the ink stream via the sonic pulse and the associated transmitted sonic impulse disconnects a certain section of the ink stream, interrupting the ink stream. Because a movement impulse transverse to the original flight path of the ink stream is transmitted to the disconnected section of the ink stream via the sonic pulse at the same time, the disconnected section thus leaves the original flight path of the ink stream and continues to fly at a certain angle to its original flight path.

Along its continued path, this section that has disconnected from the ink stream forms an ink drop due to the cohesive forces of the ink. Depending on the type of sonic pulses and their temporal succession, it is possible here according to the invention, for example, upon the separation of a section from the ink stream, to transmit at the same time a certain necessary impulse to the section to change its direction transverse to its original flight path, so that the ink drop resulting from this detached section assumes a new flight path at an acute angle to its original flight path.

If multiple sonic-energy generators, for example, sonic-energy generators of the same type, are provided along the original flight path, then it is possible for ink drops to be separated from the cohesive ink stream or from cohesive sections of the ink stream or ink drops from a stream of ink drops that have already been generated at multiple positions by means of a sonic-energy generator arrangement composed of multiple sonic-energy generators along the original flight path.

Thus, it is possible, for example, for identical ink drops to be produced and deflected into a new flight path at preferably identical deflection angles. In the case of identical deflection angles, this results in parallel flight paths of the ink drops that have been produced and/or deflected, which result in a printed line when they strike a surface to be printed.

The distance between printing dots that may be produced in this manner and thus the distance between the parallel flight paths is determined here by the distances between the drop production positions provided along the original flight path and the transmitted impulse onto the ink drops transverse to the original flight path.

Here, it is advantageous for the distance between the ink drops and/or the flight paths of the ink drops to always remain constant and not steadily increase as is the case in conventional deflection methods. Thus, the printing is guaranteed in an advantageous manner to always occur with the same print size essentially independently of the distance between the material to be printed and the inkjet printing head, so that it is possible in a simple manner for even structured surfaces to be printed with a high degree of quality.

If even deflection angles are not realized, then a group of streams of ink drops may also result that do not necessarily run parallel to one another.

In a first embodiment, provision may be made according to the invention for the sonic energy, the sonic impulse, and the impulse shape to be essentially identical at all generation positions provided, which allows the production of identical ink drops each having the same deflection impulse.

By a variation of, for example, the temporal progression of the sonic pulses and/or the intensity of the sonic pulses and/or the frequency spectrum of the sonic pulses and/or even the focusing, it is thus further possible according to the invention for ink drops having the most diverse range of sizes to be separated from an at least partially continuous and cohesive ink jet and/or to transfer different deflection impulses to these separated ink drops, resulting in different deflection angles.

If, in a first embodiment according to the invention, changes are made at the same time to production and deflection at all production positions in which the spaced sonic pulses impact the ink stream, then a group of parallel directions of deflection results, so different print sizes may be produced, for example.

The regions of the ink stream that are not required for forming a printed line and which therefore are also not deflected, may arrive in a conventional fashion in the collection opening of a collection tube and are transported back into the ink circuit, by means of a pump, for example.

Provision may be made in a second embodiment according to the invention for the respective sonic energy, the sonic impulse, and the impulse form to be adapted to the production positions provided in such a way that it is possible for ink drops of different sizes to separate from the at least partially cohesive ink stream, with the respectively transmitted deflection impulses being adapted to the present drop size in such a way that the same angle of deflection and thus parallel deflection directions result.

In a third embodiment according to the invention, in addition to a sonic-energy generator arrangement for producing adjacent sonic pulses and for deflecting individual ink drops, a second sonic-energy generator may be provided upstream that essentially serves to produce individual ink drops from a continuous and cohesive ink stream. The adjacent sonic pulses then do not impact an at least partially cohesive ink stream to produce drops that are deflected at the same time; rather, a stream of ink is produced upstream initially from the cohesive ink stream using the same sonic principle, on which ink stream the adjacent sonic pulses may then act.

Here, for example, the second sonic-energy generator arrangement separates ink drops that are essentially the same size from the continuous and cohesive inks stream using, for example, sonic pulses of the same energy, intensity, duration, and frequency composition, which drops are deflected to a second flight direction at a certain angle to their original flight direction.

As they traverse the focal points of the first sonic-energy generator arrangement for generating multiple adjacent sonic pulses at different positions along its flight path, the ink drops thus produced are then each deflected in such a way that the respective deflection directions produce a group of streams of ink drops that preferably run parallel to one another.

Here, it may be useful in a further embodiment for the second sonic-energy generator located upstream to produce from the continuous and cohesive ink stream exclusively those ink drops that are needed for a printed image to be written or, in an additional embodiment, for a continuous sequence of, in particular, equidistant ink drops to be produced by means of the second sonic-energy generator and for only the ink drops required for the printed image to be deflected further, such that in each case only one individual collection apparatus need be present for the portions of ink that are not required.

All known methods for producing sonic energy may be used as a sonic-energy generator such as, for example, electrodynamic converters, piezo converters, electrostrictive converters, magnetostrictive converters, electrostatic converters, plasma sonic-energy generators, etc.; according to the invention, at least one part of the sonic waves they produce is focused on one focal point or on a plurality of focal points.

For example, an acoustic lens, a reflector material, or a combination thereof may be used for this purpose. According to the invention, it is also possible for the sonic-energy generator and, in particular, a sonic energy-producing surface to be structured in such a way that, for example, it acts as a Fourier transform of at least one essentially punctiform sonic event and thus, in its reverse operation, bundles sonic waves emitted from this surface into at least one focal point. To this end, the sonic energy-producing surface may, for example, in a simple case, be embodied as a Fresnel zone plate, with the sonic-energy producing surface being divided into single concentric areas each of which may be individually actuated in an electrical fashion.

By appropriate electrical actuation of the respective areas with regard to amplitude, phasing, temporal progression, and frequency spectrum, it is thus possible to produce a corresponding sonic pulse without additional acoustic lenses or reflectors and to bundle this sonic pulse into at least one focal point. With an appropriate structure of the sound-producing surface and a corresponding electrical actuation of the respective areas, it is possible for multiple focal points to be produced disposed one after the other that may be actuated independently of one another, whereby different sequential deflection positions may be attained.

Embodiments and the prior art are shown in the following drawings, in which.

Figure 1:
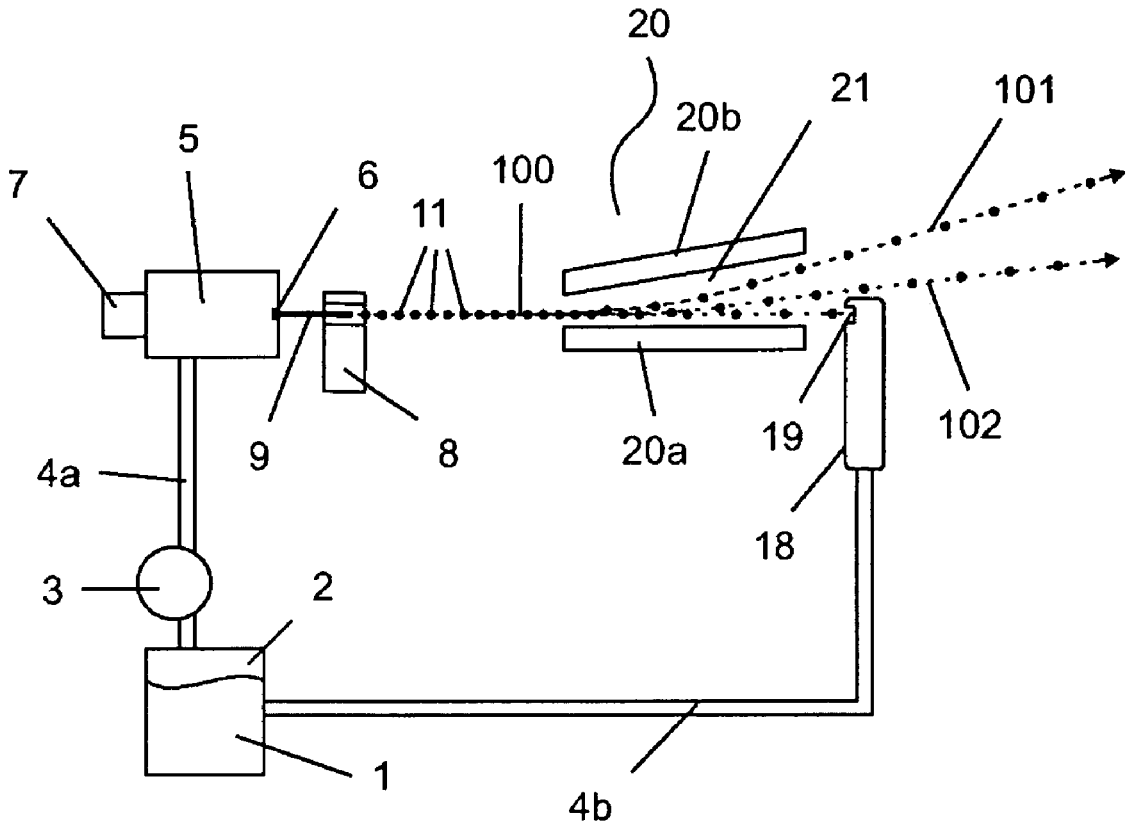
Fig. 1 Prior art
FIG. 1 shows an arrangement for the production of ink drops and the deflection thereof according to the prior art.

FIG. 1 shows by way of example a print head of the known type of a continuously operating ink-jet printer for the purposes of comparison with the present invention. Ink 1 is first pumped out of a supply container 2 by means of a pump 3 via supply lines 4*a* into a pressure chamber 5, to the end of which a nozzle 6 is attached. Via additional modulation apparatuses 7 attached to the pressure chamber, the pressure in the pressure chamber 5 is modulated such that, at a short distance after exiting, the ink stream 9 emitting from the nozzle 6 breaks up into individual ink drops 11 that are essentially the same size. Shortly before breaking up, the individual ink drops 11 are provided with an individual electrical charge via a charging electrode 8.

Along their flight path 100, the ink drops 11 then enter an electrical field 21 that is formed by means of the electrodes 20*a* and 20*b* of the plate capacitor 20. Depending on the charge magnitude and polarity of the charges on the ink drops 11 as well as the polarity and strength of the electrical field 21 in the field space of the plate capacitor 20, the individual ink drops are deflected in different spatial directions 101, 102, which are shown by way of example.

Here, the total number of possible deflection angles depends solely on the action of the charging electrode and, in principle, is not limited. Here, the individual plates 20*a* and 20*b* of the plate capacitor 20 may be tilted relative to one another as shown in FIG. 1. However, without limitation, it is equally possible to use plates that are parallel to one another.

In this embodiment, it is useful for the polarity and strength of the electrical field 21 to be kept essentially constant because a change in the field strength simultaneously affects multiple drops that are located in the field space of the plate capacitor at this time and therefore it is not possible to influence one individual drop.

After leaving the field space 21 of the plate capacitor 20, no more electrostatic force is acting on the ink drops 11 and these ink drops maintain their new flight paths 101, 102. This results in a fan-shaped array of flight paths. Ink drops 11 that, for example, have no charge or have only a low level of charge because they must be eliminated from the printed image are, for example, not deflected at all in the electrostatic field 21 or are deflected only to a small degree and arrive in an opening 19 of a collection tube 18 for ink return. The ink collected in this fashion is conveyed back into the ink container 2 via supply lines 4*b* and thus is returned to the ink cycle.

It is easy to recognize that this operating principle functions only with inks that have electrical conductivity because otherwise it is not possible to provide the ink drops with an electrostatic charge.

Figure 2:
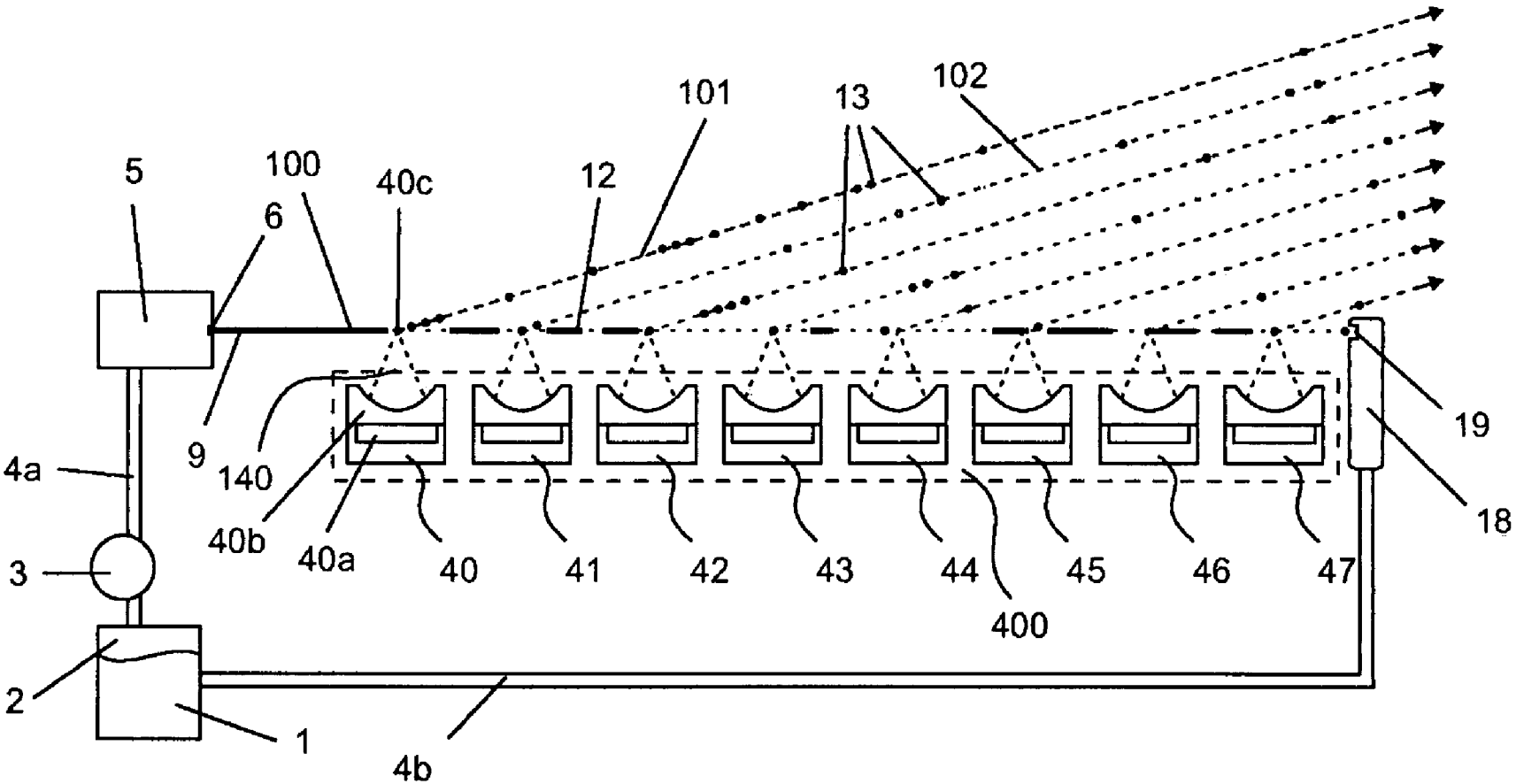
FIG. 2 shows a first embodiment according to the invention for producing identical ink drops and deflecting them in an identical manner using a first sonic-energy generator arrangement.

FIG. 2 shows a first embodiment according to the invention for producing and deflecting ink drops of an ink that is not necessarily electrically conductive and in particular an electrically nonconductive ink. To this end, the ink 1 is pumped from a supply container 2 by means of a pump 3 via supply lines 4*a* into a pressure chamber 5 with a nozzle 6 mounted on its one end.

Due to the essentially static pressure created by the pressure chamber 5, the ink 1 escapes from the pressure chamber 5 via the nozzle 6 as a continuous and cohesive ink stream 9 along a longitudinal travel direction 100 and, after a certain distance, arrives in the region of the sonic-energy generator arrangement 400 which, for example, includes a row of sonic-energy generators 40, 41, 42, . . . , 47 provided one after the other along the direction 100. Here, each of the sonic-energy generator systems 40, 41, 42, . . . , 47 includes, for example, a sonic-energy generator 40*a*, 41*a*, 42*a*, . . . , 47*a* located in a holder 40*d*, 41*d*, 42*d*, . . . , 47*d*, each sonic-energy generator having a focusing apparatus 40*b*, 41*b*, 42*b*, . . . , 47*b* on its side facing the ink stream 9.

Here, the distance between the sonic-energy generator systems 40, 41, 42, . . . , 47 and the ink stream 9 and, in particular, the structure of the focusing apparatuses 40*b*, 41*b*, 42*b*, . . . , 47*b* is determined such that the focal points of the focusing apparatuses 40*b*, 41*b*, 42*b*, . . . , 47*b* fall on the ink stream 9 moving along the longitudinal travel direction 100. In this manner, the sonic pulses 140, 141, 142, . . . , 147 emitted by the sonic-energy generators 40*a*, 41*a*, 42*a*, . . . , 47*a* are concentrated on the ink stream 9 in such a small area that a certain sonic energy and a certain sonic impulse are transferred to a certain region of the ink stream 9 in the respective focal points 40*c*, 41*c*, 42*c*, . . . , 47*c*. The first sonic-energy generator 40*a* separates a section of a certain length from the ink stream 9 that is still continuous and cohesive. After initial separation of a drop, the subsequent sonic-energy generators then only act on the ink stream, which is still at least partially cohesive.

Depending on the respective pulse duration, pulse form, frequency composition, and sonic energy used in the sonic-energy generators 40*a*, 41*a*, 42*a*, . . . , 47*a*, more or less sonic energy and therefore a sonic impulse of greater or lesser magnitude is transferred to the separated length section in question, such that the respective length sections may be given a certain angle of deflection, thus enabling individual length sections to be produced in a targeted fashion by a corresponding actuation of the sonic-energy generator systems 40, 41, 42, . . . , 47 by means of a supervisory control unit, which is not shown, thus, for example, addressing a printed line.

Due to cohesive forces acting inside the ink, the length sections thus separated shortly form individual ink drops 13 along their respective further deflection directions 101, 102 which may be used in a known fashion for printing or labeling.

Because the ink drops 13 required for printing are produced at different positions along the dispersion direction 100 each having identical deflection angles, the new flight directions 101, 102 of the ink drops 13 form a parallel group relative to one another, resulting in an even print size independently of the distance from the printing head to the material to be printed. Here, the size of the printing essentially depends on the original speed of the ink stream in the direction 100, the distance between the sonic-energy generator systems 40, 41, 42, . . . , 47, and the respective deflection impulse transmitted transverse to the flight direction.

Length sections of the ink stream that are not necessary for a printed image and thus must be removed are not deflected by the sonic-energy generating systems 40, 41, 42, . . . , 47 such that they continue to fly undeflected along their original dispersion direction 100 and arrive in a collection opening of a collection tube 18 and are transported back into the ink circuit in a known fashion.

Figure 3:
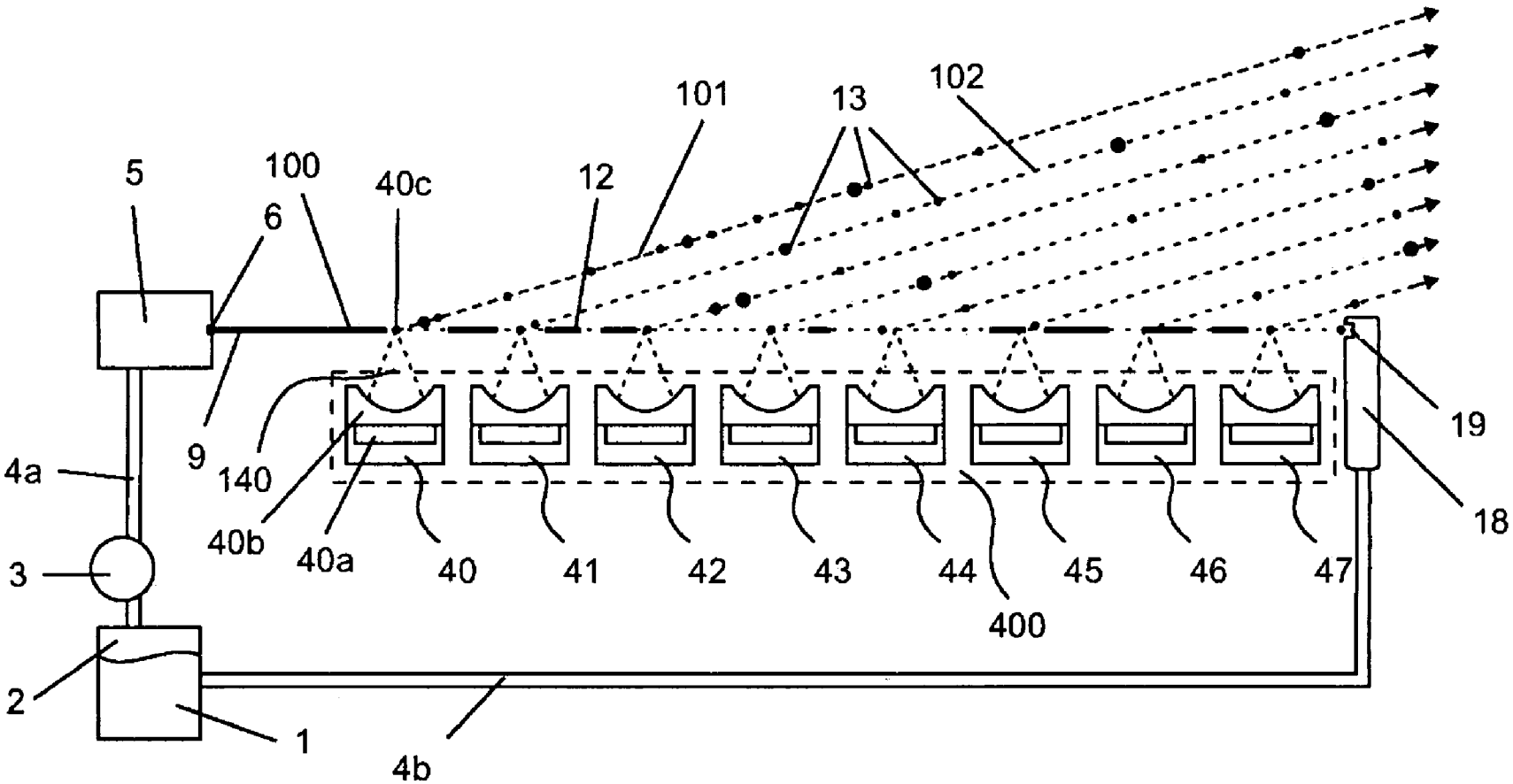
FIG. 3 shows a second embodiment according to the invention for producing variable ink drops and deflecting them in an identical manner using a first sonic-energy generator arrangement.

FIG. 3 shows a second embodiment according to the invention for producing and deflecting ink drops in which it is possible, by means of variant actuation of the deflection systems 40, 41, 42, . . . , 47, to produce different drop sizes while being able to keep the respective angles of deviation constant. To this end, for example, the respective impulse durations and/or amplitudes and/or impulse quantities and/or focusing of the respective sonic-energy generator systems 40, 41, 42, . . . , 47 is adapted in such a way that sections of different lengths may be separated from the ink stream that, due their interior cohesive forces, shortly form ink drops.

Figure 4:
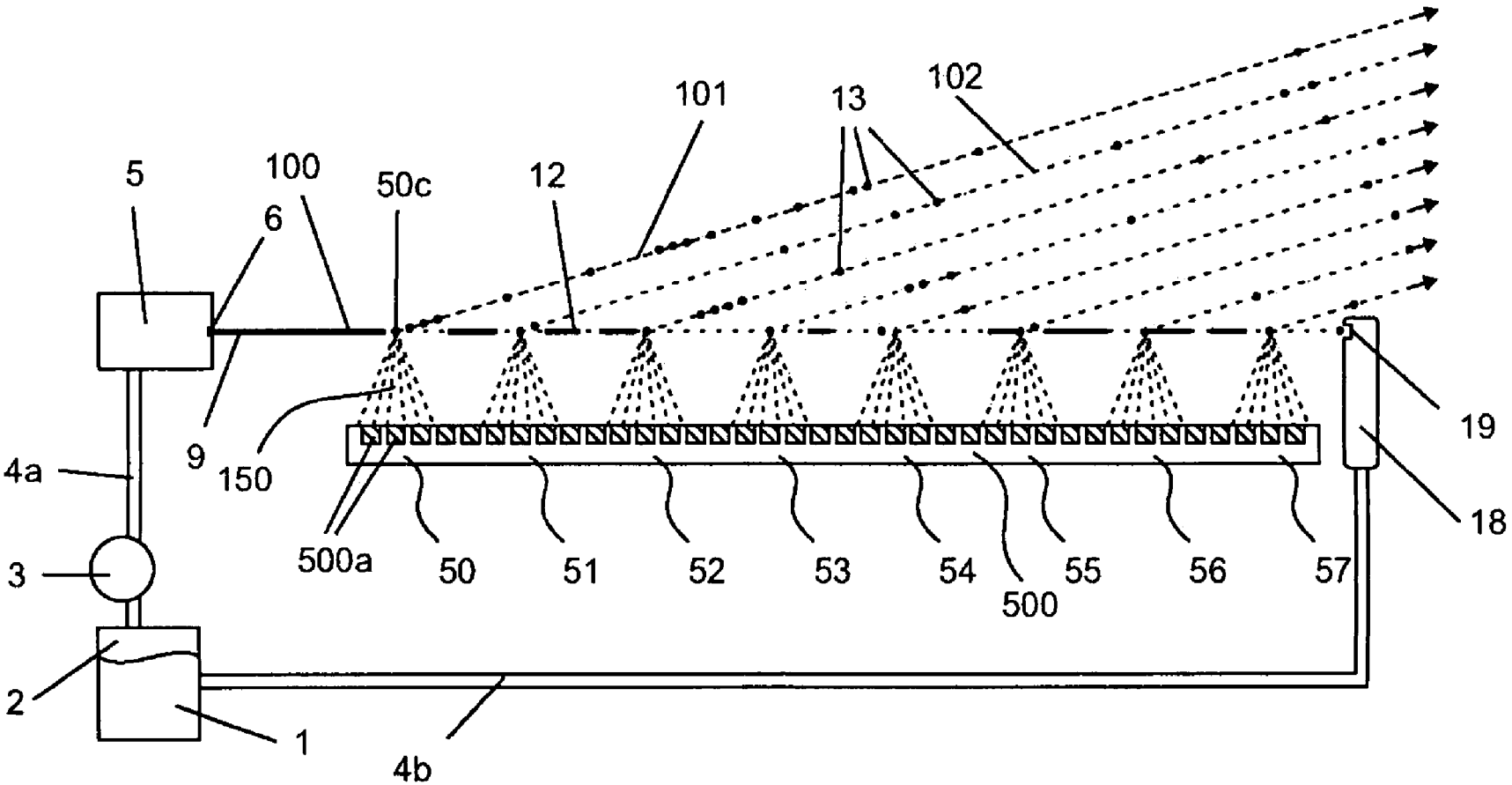
FIG. 4 shows a third embodiment according to the invention for producing ink drops and deflecting them using a first Fourier-transformed sonic-energy generator arrangement.

FIG. 4 shows a third embodiment according to the invention for producing and deflecting ink drops; in this embodiment, the sonic-energy generator arrangement 500 is embodied such that it may be operated in certain regions 50, 51, 52, . . . 57 as respective Fourier transforms of a respective punctiform sonic event.

Thus, it is possible for such a sonic-energy generator arrangement 500 to be operated without a focusing apparatus because the sonic waves 150, 151, 152, . . . 157 may be bundled into respective common focal points 50*c*, 51*c*, 52*c*, . . . 57*c* upon appropriate actuation of the respective sonic energy-producing segments 500*a* combined into a certain number of regions 50, 51, 52, . . . 57 by overlapping the respective amplitudes and phases, whereby individual length sections may be separated from the ink stream 9 and deflected in a manner similar to that described above.

Thus, for example, it is also possible for the respective focal points 50*c*, 51*c*, 52*c*, . . . 57*c* to be entrained with the respective ink drops to be deflected, at least for a certain distance, during the sonic pulse, which allows a particularly effective transfer of sonic energy to the drops. By the combination of a certain number of sonic energy-producing segments 500*a* into a respective area, it is also possible to optionally create a variant number of areas and thus a variant number of deflected ink stream directions 101, 102.

Figure 5:
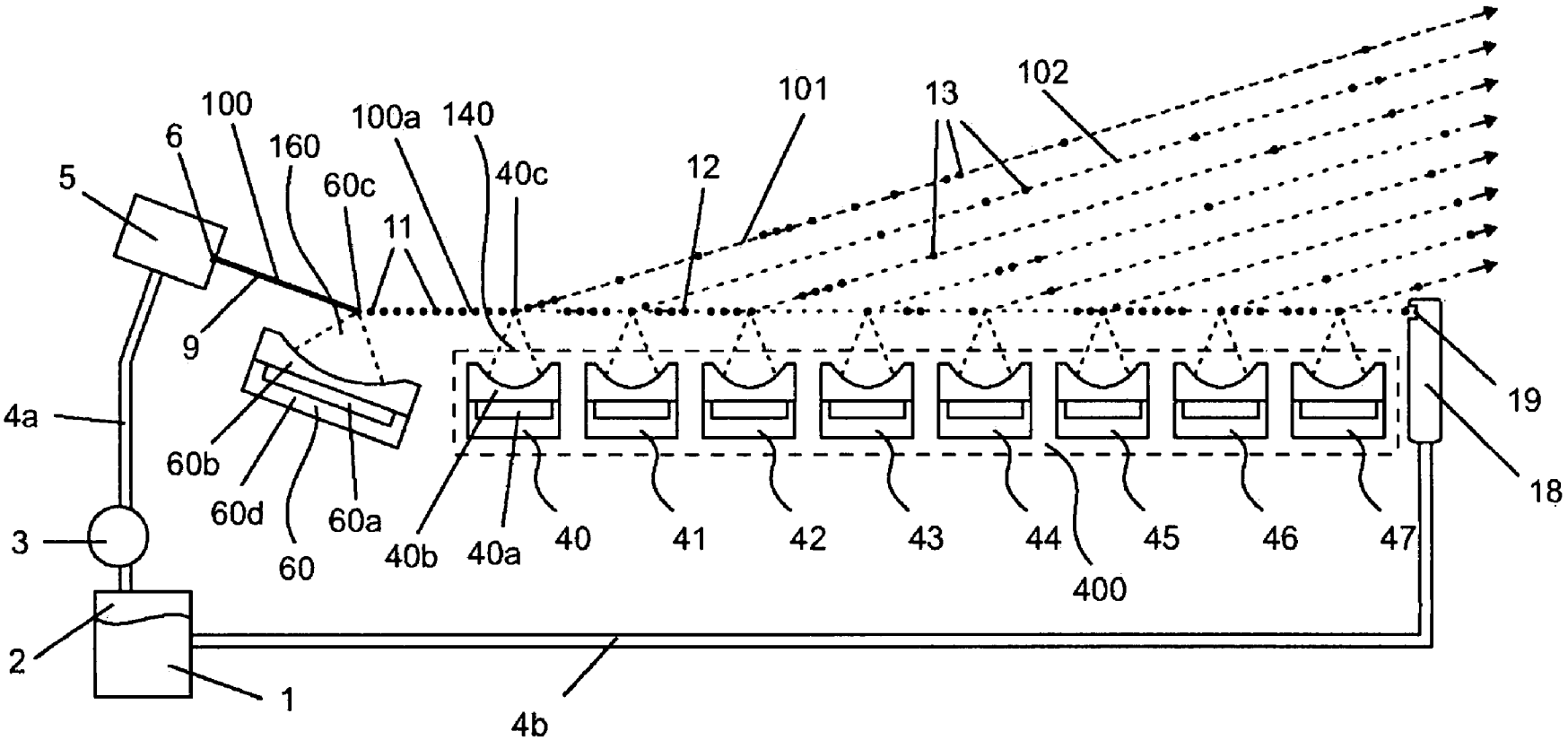
FIG. 5 shows a fourth embodiment according to the invention having two sonic-energy generator arrangements independent of one another with continuous drop production.

FIG. 5 shows a fourth embodiment according to the invention for producing and deflecting ink drops; in this embodiment, a second sonic energy generating system 60 is provided upstream, provided between the pressure chamber 5 and the first sonic-energy generator arrangement 400.

By means of an appropriate actuation of the sonic-energy generating system 60 using a supervisory control unit (not shown), it is thus possible for the continuous and cohesive ink stream 9 to be fragmented in a first step into a series of equal, in particular equidistant, ink drops 11 in a first step in that, for example, a certain frequency of sonic pulses with an essentially identical temporal progression, identical amplitude and phase, and an identical frequency spectrum and/or focusing acts on the ink stream 9.

To this end, the sonic-energy generator system 60 has, for example, a receiving apparatus 60*d* for accommodating a sonic-energy generator element 60*a* as well as a focusing apparatus 60*b* by means of which the sonic waves 160 produced by the sonic-energy generator element 60*a* are focused onto a focal point 60*c*, which is located at a certain point along the dispersion direction 100 of the ink stream 9. In this manner, it is possible to fragment the ink stream 9 by means of an appropriate series of sonic pulses into a series of essentially identical ink drops that, due to a deflection impulse applied to them at the same time, are deflected into a first new deflection direction 100*a*.

Here, the first sonic-energy generating arrangement 400 provided downstream is provided along the new deflection direction 100 a in such a way that the focal points 40*c*, 41*c*, 42*c*, . . . , 47*c* of the respective sonic-energy generating system 40, 41, 42, . . . , 47 are located on the dispersion direction 100*a*. Thus, it is possible for individual ink drops that were previously produced by means of the sonic-energy generating system 60 to be deflected out of their dispersion direction 100*a* into a new, second deflection direction 101, 102 by means of a synchronized sonic impulse.

The synchronization between the production of the ink drops by means of the sonic-energy generating system 60 and the respective deflection by one of the sonic-energy generating systems 40, 41, 42, . . . , 47 may, for example, occur electronically or by means of sensors (not shown) provided along the flight path 100*a*, whereby the position and/or the frequency of the drops may be determined. Ink drops not intended for printing arrive in the usual manner in a collection opening 19 of a collection tube 18 and are returned to the ink circuit via return lines 4*b*.

Figure 6:
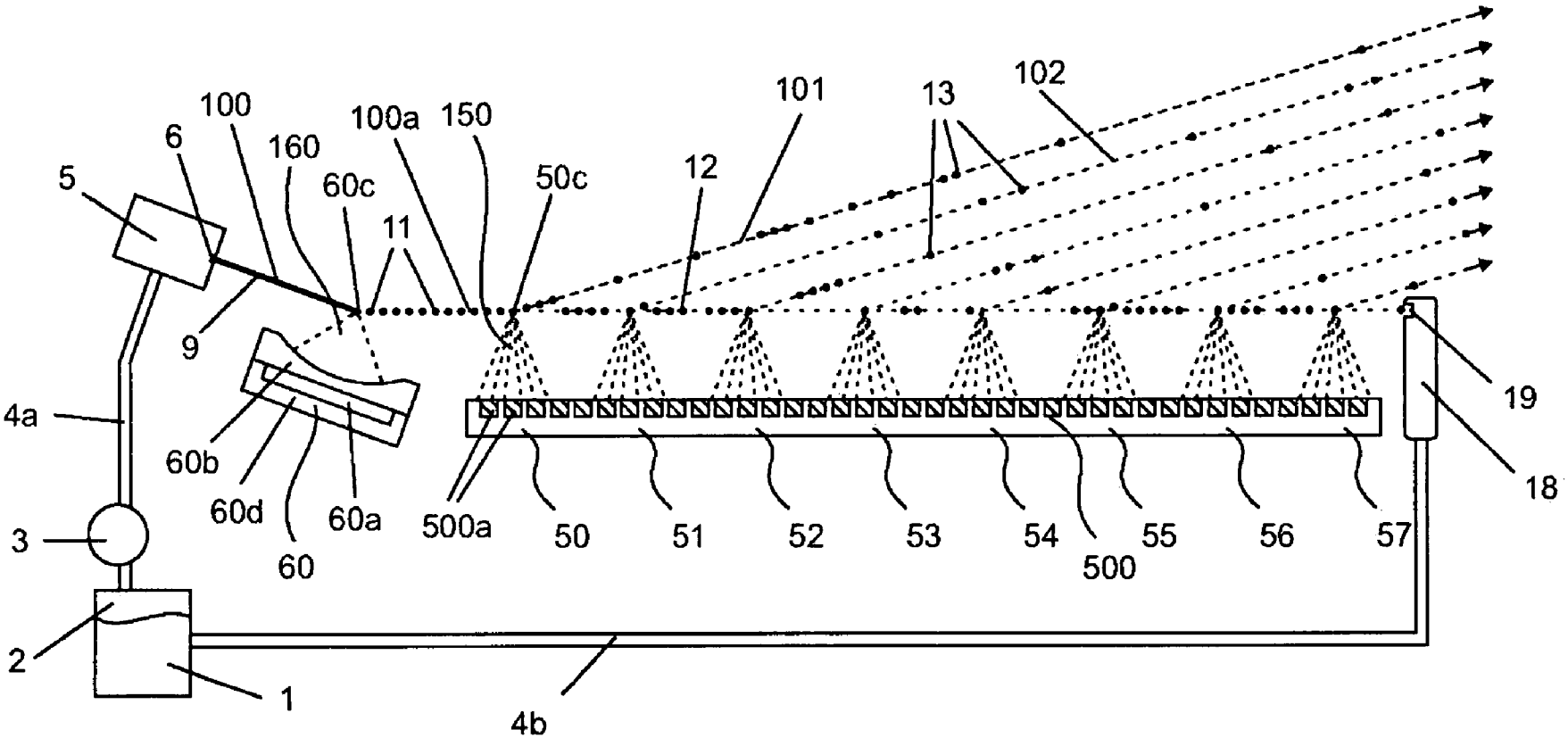
FIG. 6 shows a fifth embodiment according to the invention having two sonic-energy generator arrangements with selective drop production.

FIG. 6 shows a fifth embodiment according to the invention for producing and deflecting ink drops; in this embodiment, as in the fourth embodiment according to the invention described above, a second sonic-energy generating system 60 is provided, which is provided between the pressure chamber 5 and a first sonic energy production arrangement 500 used in this embodiment, which operates as a "Fourier-transformed" sonic-energy generating system.

Because the focal points 50*c*, 51*c*, 52*c*, . . . , 57*c* of the sonic waves may be produced by a corresponding actuation of the associated sonic energy-producing segments 50*a*, 51*a*, 52*a*, . . . , 57*a*, it is also possible to produce, for example, a variant number of focal points 50*c*, 51*c*, 52*c*, . . . by combining more or fewer segments 500*a* into respective segment groups and forming a focal point 50*c*, 51*c*, 52*c*, . . . by appropriate actuation. In this manner, for example, it is also possible for the respective focal point to be entrained for at least a certain distance with the ink drops to be deflected, by means of which a particularly effective transfer of the sonic energy onto the drops may occur.

Figure 7:
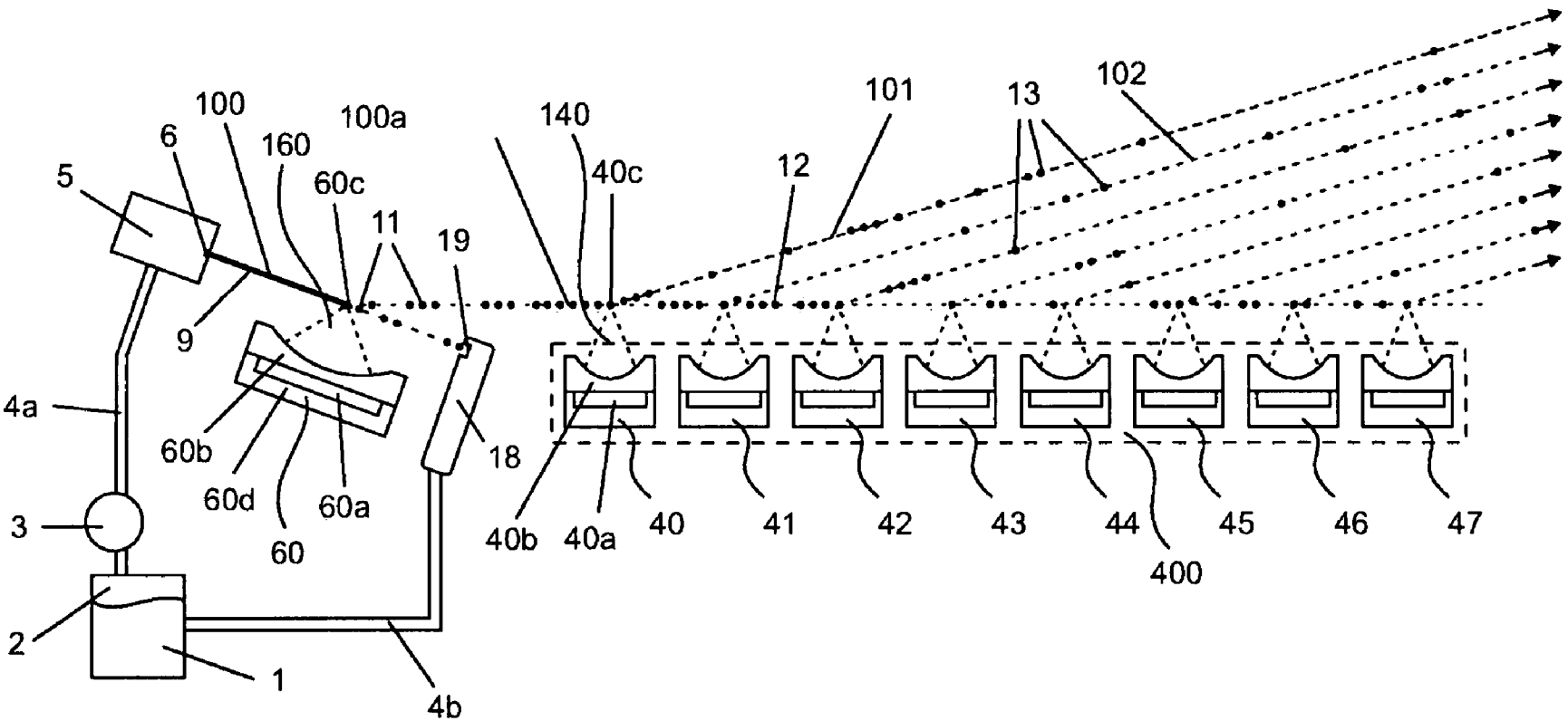
FIG. 7 shows a sixth embodiment according to the invention with three sonic-energy generator arrangements independent of one another.

FIG. 7 shows a sixth embodiment according to the invention for producing and deflecting ink drops; in this embodiment, as has already been described, a second sonic-energy generator system 60 is present for producing ink drops. Here, however, the sonic-energy generator system 60 is used to produce only those ink drops from the cohesive ink stream 9 that will be used for printing. In this embodiment, section lengths of the ink stream 9 that are not needed arrive in the collection opening 19 of a collection tube 18, which is provided directly downstream of the sonic-energy generating system 60 in the dispersion direction 100 of the ink stream. It is self-evident that, instead of the sonic-energy generating arrangement for deflecting the ink streams that is shown by way of example, a sonic-energy generating arrangement 500 acting as a Fourier transform may also be used here.

In particular, it is also advantageously possible for ink drops of various sizes to be produced from the continuous ink stream using the second sonic-energy generating system; their corresponding deflection by means of the first sonic-energy generating arrangement may be synchronized to the respective size of the drops and the desired deflection direction.

With regard to all embodiments, it should be noted that the technical features discussed in conjunction with one embodiment may be used not only in that specific embodiment, but also in each of the other embodiments. All technical features disclosed in this specification are to be viewed as essential to the invention and may be used alone or in any desired combination.

The invention claimed is:

1. A method for producing and/or deflecting ink drops, in particular of a continuously operating ink-jet printer, in which a continuous, cohesive stream is emitted from a nozzle of an ink chamber wherein sonic pulses act transversely on an ink stream at a spacing from one another along the dispersion direction of the ink stream, which is at least partially cohesive or in the form of drops; by the effect of each of the spaced sonic pulses on the ink stream an ink drop may be separated from the ink stream and/or deflected, in particular by the same angle, from the original dispersion direction of the ink stream, such that a group of ink drop streams, in particular parallel ink drop streams, may be/is produced.

2. The method according to claim 1 wherein the spaced sonic pulses impact the ink stream, which is at least partially cohesive, transversely to its dispersion direction, and a section of the ink stream on which one of the spaced sonic pulses is acting, is separated from the at least partially cohesive ink stream and deflected from its original dispersion direction, with the separated section forming an ink drop during its flight due to cohesive forces.

3. The method according to claim 1 wherein, at one point of the cohesive ink stream, sonic pulses acting transversely on the ink stream before the spaced sonic pulses both in terms of time and location each separate one section of the ink stream on which such a sonic pulse is acting from the cohesive ink stream and deflect it from its original dispersion direction, with the separated section forming an ink drop during flight due to cohesive forces such that a deflected ink stream in the form of drops is produced, along whose dispersion direction the spaced sonic pulses act on the respective ink drops.

4. The method according to claim 3 wherein the cohesive ink stream is impacted by consecutive sonic pulses transverse to the dispersion direction of the ink stream in such a way that ink stream sections result that have been deflected and not deflected from their original dispersion direction, with sections that have not been deflected arriving in a collection apparatus provided in the original dispersion direction and being returned to the ink circuit, and with the deflected section s forming an ink stream in the form of drops on which the spaced sonic pulses act along the dispersion direction.

5. The method according to claim 3 wherein the cohesive ink stream is impacted by consecutive sonic pulses transverse to the dispersion direction of the ink stream in such a way that only ink stream sections that have been deflected from their original dispersion direction result that form an ink stream in the form of drops with essentially equidistant ink drops on which the spaced sonic pulses act along the dispersion direction.

6. The method according to claim 1 wherein, in order to generate the sonic pulses, sonic-energy generators that may be actuated in a pulsed fashion are used that are located outside of the pressure chamber and are provided along the dispersion direction of the ink stream, which is at least partially continuous and cohesive or in the form of drops, with the sonic-energy generator producing respective sonic pulses that are directed transversely onto the respective ink stream, in particular at a right angle.

7. The method according to claim 1 wherein ink drops are selectively separated from the ink stream, which is at least partially cohesive or in the form of drops, by sonic pulses acting on the ink stream transverse to the dispersion direction of the ink stream.

8. The method according to claim 1 wherein the separated sections form ink drops that are essentially the same size.

9. The method according to claim 1 wherein the separated sections form ink drops of different sizes.

10. The method according to claim 1 wherein ink drops of different sizes are deflected from the ink stream in parallel directions by multiple independent sonic pulses located at a spacing from one another transverse to the dispersion direction of the at least partially cohesive ink stream.

11. The method according to claim 1 wherein the drops or at least partially cohesive sections that are not deflected from an ink stream arrive in a collection apparatus and are returned to the ink circuit.

12. The method according to claim 1 wherein the sonic pulses are focused on the ink stream, which is at least partially cohesive or in the form of drops.

13. The method according to claim 12 wherein the sonic pulses are focused on a section of the at least partially cohesive ink stream or an ink drop by a focusing apparatus.

14. The method according to claim 1 wherein the sonic pulses are generated by means of at least one electrodynamic, electrostatic, magnetodynamic, magnetostatic, or piezo electric converter.

15. The method according to claim 1 wherein a sonic pulse is generated by means of a sonic-energy generator whose form and/or arrangement of sonic generator elements corresponds to the Fourier transform of at least one essentially punctiform sonic pulse at a spacing from the ink stream such that, by an actuation of the sonic-energy generator, at least one sonic pulse is produced that is focused on the ink stream with no additional focusing elements.

16. The method according to claim 1 wherein the focus of the sonic pulse is entrained during its duration with the movement of the ink stream.

17. The method according to claim 15 wherein the number of focal points may be selectively varied by a logical combination of different sonic energy-producing elements/segments at different areas.

18. The method according to claim 1 wherein the strength of the deflection of a section or drop is dependent upon and/or controlled by the energy and/or pulse and/or focusing of a sonic pulse.

19. The apparatus according to claim 17 wherein a sonic-energy generator has a form and/or arrangement of sonic-energy generator elements that correspond to the Fourier transform of at least one essentially punctiform sonic pulse at a spacing from the ink stream such that, by an actuation of the sonic-energy generator, at least one sonic pulse may be produced that is focused on the ink stream without any additional focusing elements.

20. The apparatus according to claim 19 wherein the number of focal points may be varied selectively by a logical combination of various sonic-energy generator elements in different areas.

21. The apparatus according to claim 19 wherein the respective focal points may be entrained with the movement of the ink stream during the respective duration of the respective sonic impulse.

22. An apparatus for producing and/or deflecting ink drops from an ink stream that is at least partially cohesive or in the form of drops, including a pressure chamber with a nozzle for producing a continuously emitted, cohesive ink stream wherein multiple sonic-energy generators are provided at a spacing from one another along the dispersion direction next to an ink stream that is at least partially cohesive or in the form of drops, by means of which spaced sonic pulses may be produced; by the effect of each of the spaced sonic pulses on the ink stream, an ink drop may be separated from the ink stream and/or deflected from the original dispersion direction of the ink stream, in particular by the same angle, such that a group of ink drop streams may be produced, in particular parallel to one another.

23. The apparatus according to claim 22, wherein ink drops may be selectively separated from the ink stream, which is at least partially cohesive or in the form of drops.

24. The apparatus according to claim 22 wherein the regions of the ink stream that were not separated arrive in a collection apparatus and are returned to the ink circuit.

25. The apparatus according to claim 22 wherein a sonic-energy generator is embodied as an electrodynamic and/or electrostatic and/or magnetodynamic and/or magnetostatic and/or piezo electric converter.

26. The apparatus according to claim 22 wherein it has at least one focusing apparatus for focusing sonic pulses on a section of the ink stream, which is at least partially cohesive or in the form of drops.

* * * * *